United States Patent [19]

Hegedus et al.

[11] Patent Number: 4,965,946

[45] Date of Patent: Oct. 30, 1990

[54] DISPLAY CARD OR MOUNT

[75] Inventors: Leslie J. Hegedus, London; Bruce Grove, Guildford, both of United Kingdom

[73] Assignee: Leslie J. Hegedus, London, United Kingdom

[21] Appl. No.: 299,258

[22] Filed: May 19, 1989

[30] Foreign Application Priority Data

Jan. 21, 1988 [GB] United Kingdom ..... 8801343

[51] Int. Cl.[5] ..... G09F 1/10

[52] U.S. Cl. ..... 40/124.4; 40/152.1; 40/538; 40/539; 248/152; 248/459; 248/460

[58] Field of Search ..... 40/124.1, 124.2, 124.4, 40/538, 539, 152.1, 154, 156; 248/150, 152, 174, 166, 459, 460, 463

[56] References Cited

U.S. PATENT DOCUMENTS

| | | | |
|---|---|---|---|
| 969,831 | 9/1910 | Alsop | 248/174 |
| 1,539,028 | 5/1925 | Storer | 40/539 |
| 2,021,018 | 11/1935 | Paige | 40/154 |
| 2,047,416 | 7/1936 | Horwath | 40/539 |
| 2,080,997 | 5/1937 | Beckelman | 40/539 |
| 2,084,635 | 6/1937 | Friedrich et al. | 248/152 |
| 2,241,075 | 5/1941 | Sunderhauf et al. | 248/152 |
| 2,780,017 | 2/1957 | Paige | 248/174 |
| 4,366,636 | 1/1983 | Hearsh | 40/152.1 |

*Primary Examiner*—Kenneth J. Dorner
*Assistant Examiner*—J. Hakomaki
*Attorney, Agent, or Firm*—Joseph S. Iandiorio

[57] ABSTRACT

A member of sheet material has cut out portions and fold lines, so that when it is folded up and central areas attached together to form a spine display areas are provided in different planes. The display area may be used to display a photograph or picture having with any one of a large range of sizes. The bottom edge of the member may have a V-shaped cut-out so that it leans back slightly when erected.

10 Claims, 2 Drawing Sheets

DISPLAY CARD OR MOUNT

BACKGROUND OF THE INVENTION

The present invention relates to a display card or mount or frame and more particularly to those which comprise display surfaces in more than one parallel plane.

From U.S. Pat. No. 2,241,075 there is known a display device which can be made from a flat sheet. It has a central fold line and further fold lines which define a spine and panel portions. However, the further fold lines are inclined at an angle to the central fold line, and the device is for displaying three-dimensional articles. This prior document corresponds to the first part of claim 1. Another display device is disclosed in U.S. Pat. No. 1,986,550 which is also for use with three-dimensional articles. Neither U.S. Patent discloses a device suitable for displaying two- dimensional articles such as photographs or pictures and both are very old.

SUMMARY OF THE INVENTION

According to the present invention there is provided a member comprising a sheet of material for making a display mount comprising a central fold line extending across said sheet to its periphery, wherein there are provided a plurality of further fold lines at each side of said central fold line and parallel thereto, said further fold lines having ends spaced from the periphery of said sheet, and a plurality of cut lines extending between said ends of said further fold lines.

BRIEF DESCRIPTION OF THE DRAWINGS

Preferred embodiments of the present invention will now be described, by way of example only, with reference to the accompanying drawings, of which.

DESCRIPTION OF THE PREFERRED EMBODIMENTS

Figure 1:
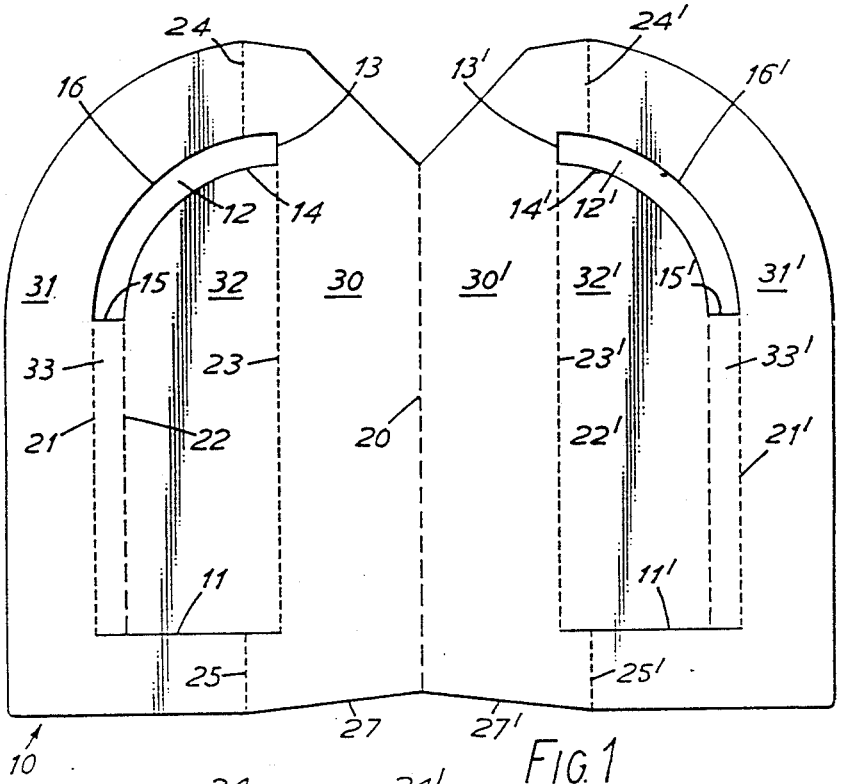
FIG. 1 is a front view of a blank from which a card in accordance with a first embodiment of the present invention is folded.

Basically the present invention provides a member of sheet material for making a display mount comprising a central fold line extending across the sheet to the periphery thereof, characterised in that there are provided a plurality of further fold lines at each side of the central fold line and parallel thereto but not extending to the periphery of the sheet, and a plurality of cut lines extending between the ends of said further fold lines.

This arrangement permits a single sheet of material to be made into a mount for a wide range of sizes of photographs, pictures, etc.

The invention also includes a card as such greetings card comprising a said member folded about its central fold line, with specified areas immediately adjacent to the central fold line on both sides thereof being firmly attached together.

The invention also includes a display card, mount or frame comprising a said member wherein specified areas immediately adjacent to the central fold line on both sides thereof are firmly attached together and the remaining regions form display areas in a plurality of parallel planes.

Referring now to the drawings, in FIGS. 1, 3, 4 and 6 (but not FIGS. 2 and 5) folds away from the viewer are indicated by dotted lines and folds towards the centre line of the card are indicated by dashed lines.

Figure 2:
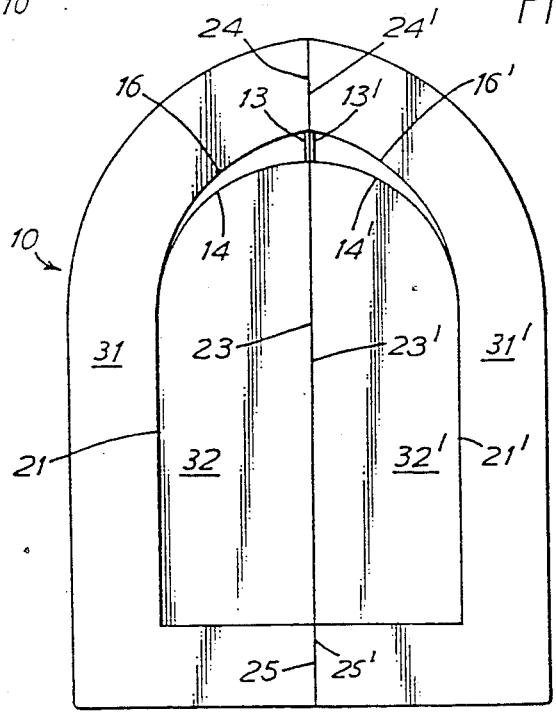
FIG. 2 is a front view of the erected card of FIG. 1.
Figure 3:
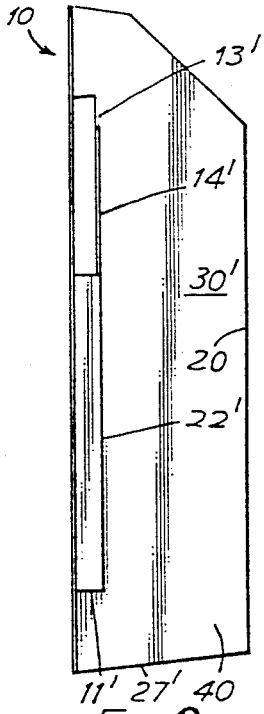
FIG. 3 is a side view of FIG. 2.

Referring now to FIGS. 1 to 3 there is shown a card 10. FIG. 1 shows the card in the flat form in which it is made. It will be noted that it comprises two cuts 11, 11' which are made without removing material from the card and cut out portions 12, 12' which involve the removal of an area of the material to define edges 13, 14, 15 and 16 etc. The card material is scored along lines 20 to 25 to define areas of card 30 to 33 on the left hand side of the card with corresponding elements on the right hand side of the card being indicated with a dash.

The card is then folded as outlined in the last paragraph but one and the entire areas 30 and 30' are then firmly adhered together to form a firm spine 40, with lines 24, 24' and 25, 25' closely abutting. The card can then be stood upright as shown in FIGS.2 and 3 with areas 31 and 31' lying in a first plane and areas 32, 32' lying in a second plane behind the first plane at a distance equal to the length of sides 15, 15'. The edges 27, 27' forming the base of the spine may be sloped slightly so that the card stands with the display surfaces 31, 31', 32, 32' directed slightly upwardly.

The display surfaces may carry any desired surface decoration or picture, or words such as a pre-printed greeting or an advertisement. Alternatively a photograph or picture may be adhered to the erected card, preferably to the flat area formed by areas 32, 32'. The stiffness of the photograph or picture assists in maintaining the respective display surfaces coplanar.

An advantage of the above-described embodiment is that is forms an attractive display card which is simple to make and erect. A particular advantage is that, even when areas 30 and 30' are adhered together, the card may be folded completely flat with the two halves folded together like a conventional greeting card. Thus the card could be posted in an envelope with a photograph or other picture preferably having an arched shape to exactly fit the area formed by areas 32, 32'. The recipient simply opens the card, folds it along the fold lines and mounts the photograph in position, e.g. by adhesive.

Various modifications may be made to the above described embodiment. For example the periphery of the card and the cut out portions may have any desired shape.

Figure 4:
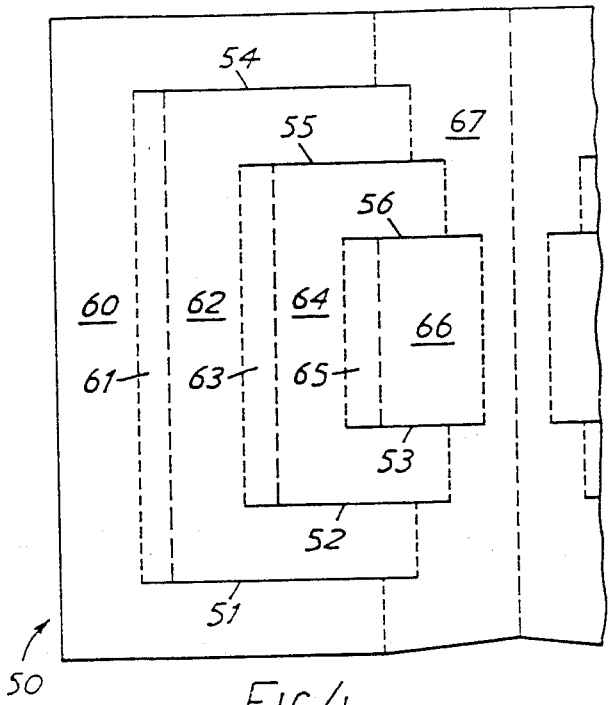
FIG. 4 is a front view of half a blank from which a card in accordance with a second embodiment is folded.
Figure 6:
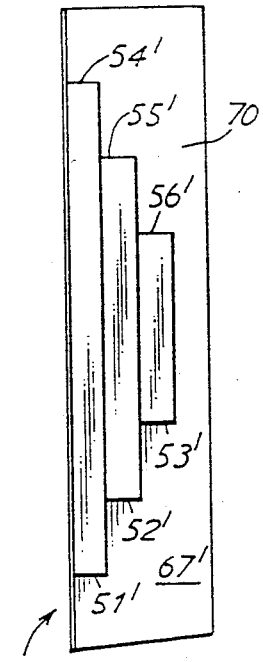
FIG. 6 is a side view of FIG. 5.
Figure 5:
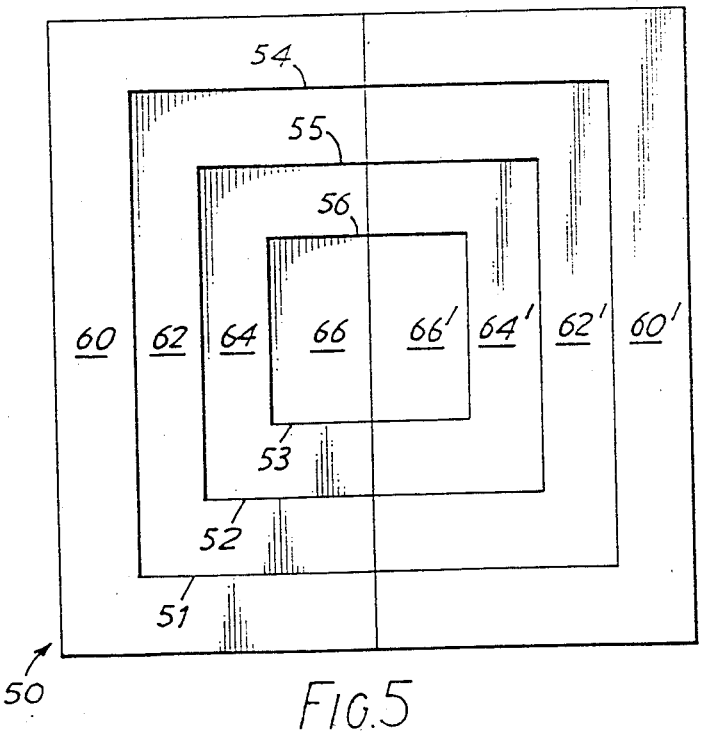
FIG. 5 is a front view of the erected card of FIG. 4.

Any desired number of folded lines may be provided depending upon the number of different levels desired. FIGS. 4 to 6 show a modified card 50 with display areas in four parallel planes. The card 50 has a number of cuts 51 to 56 all of which are made without the removal of material from the card. The material of the card is then scored along the dotted and dashed lines to define areas 60–67 on the left-hand side of the card with corresponding areas on the right-hand side of the card being indicated with a dash. The card 50 is then folded in a manner generally similar to that employed with card 10, and areas 67, 67' are then firmly adhered together to form a firm spine 70. When the card is erected, see FIG. 5, the areas 60, 60'; 62, 62'; 64, 64' and 66, 66' lie in four respective parallel planes.

This arrangement permits a single card to be used for a wide range of sizes of photographs, pictures etc. If desired, detachable cards bearing calender information may be provided with successive cards being removed from the larger surfaces to reveal the card below. The calender cards may be lightly and removably attached to the display card by a suitable adhesive etc.

Although selected ones of the display areas of the above-described embodiments may be pre-printed with wording and/or decoration, the card is particularly suitable for displaying a photograph or picture. The display area and plane selected depends upon the size of the photograph or picture to be displayed. The card may be made square or rectangular depending upon the shape of the photograph or picture to be displayed.

display mounts as described above may be made of a wide range of materials having a wide range of thickness and stiffnesses, e.g. metal foil.

The card may be sold as a post card, which is arranged to be cut, scored and folded along printed lines by the recipient, especially a child. The display areas may carry parts of a picture which form a complete picture when the card is erected.

The card may be sold in a form corresponding to any stage of its manufacture, i.e. from a rectangular card simply bearing markings where it is to be cut and folded, to an erected card as shown in FIGS. 2 and 3 or FIGS. 5 and 6, with a suitable photograph etc. mounted on a display area.

Preferred forms are:

(i) flat as in FIGS. 1 and 4, without adhesive;

(ii) flat, as in FIGS. 1 and 4, with adhesive on one or both areas 30, 30' (67, 67'), the adhesive being such that the areas firmly adhere to each other on contact.

(iii) flat, folded in the form of a greetings card, (e.g. corresponding to FIG. 2 but with area 31' folded over to touch area 31 and with spine 40 also lying in the same place).

As an alternative to adhesive, tape or staples may be used to secure areas 30, 30' (67, 67') together. The display member may be of any suitable material e.g. thin or thick card, plastics material or metal foil.

It will be understood that the above description of the present invention is susceptible to various modifications, changes and adaptations.

What is claimed is:

1. A member comprising a sheet of material for making a display card or mount comprising a central fold line extending across said sheet to its periphery, wherein there are provided a plurality of further fold lines at each side of said central fold line and parallel thereto, said further fold lines having ends spaced from the periphery of said sheet, and a plurality of cut lines extending between said ends of respective ones of said further fold lines, wherein at each side of said central fold line, said central fold line and adjacent ones of said further fold lines at each side of said central fold line define a respective spine area, said spine areas being arranged to engage each other upon folding of said central fold line, and respective areas of said sheet on opposite sides of said spine are arranged to be substantially coplanar upon folding of the remaining fold lines.

2. A member according to claim 1 wherein one or more areas of material are removed from said sheet, at least some of said cut lines comprising some of the edges of said area(s).

3. A member according to claim 1 wherein there are at least first, second and third ones of said further fold lines at each side of said central fold line, said first further fold line defining an edge of said spine area, and being arranged to be folded so that a first area of said sheet at the side of said first further fold line remote from said spine area is, in use, perpendicular to said spine, said first area extending to said second further fold line, said second further fold line being arranged to be folded so that a second area of said sheet at the side of said second further fold line remote from said spine area is, in use, parallel to said spine, said second area extending to said third further fold line, said third further fold line being arranged to be folded so that a third area of said sheet at the side of the third further fold line remmote from said spine area is, in use, perpendicular to said spine.

4. A member according to claim 3, wherein said cut lines and said fold lines are mirror images of each other about said central fold line.

5. A member according claim 1, wherein there is a relatively-shallow V-shaped cut out in the bottom edge of said sheet, the apex of said V-shape coinciding with the bottom end of said central fold line.

6. A member comprising a sheet of material for making a display card or mount comprising a central fold line extending across said sheet to its periphery, wherein there are provided a plurality of further fold lines at each side of said central fold line and parallel thereto, said further fold lines having ends spaced from the periphery of said sheet, and a pluralilty of cut lines extending between said ends of respective ones of said further fold lines, wherein, in use, upon folding the member, respective areas of said sheet on opposite sides of said central fold line are arranged to be substantially coplanar.

7. A member according to claim 6, wherein at each side of said central fold line, said central fold line and adjacent ones of said further fold lines at each side of said central fold line define a respective spine area, said spine areas being arranged to engage each other upon folding of said central fold line.

8. A member according to claim 7 wherein said respective areas of said sheet are arranged to be substantially perpendicular to said spine.

9. A member according to claim 8 wherein there is a relatively-shallow V-shaped cut out in the bottom edge of said sheet, the apex of said V-shape coinciding with the bottom end of said central fold line.

10. A member according to claim 6 wherein one or more areas of material are removed from said sheet, at least some of said cut lines comprising some of the edges of said area(s).

* * * * *